US011674286B2

(12) United States Patent
Smith et al.

(10) Patent No.: US 11,674,286 B2
(45) Date of Patent: Jun. 13, 2023

(54) DREDGE HEAD ASSEMBLY AND RELATED DIVER-ASSISTED DREDGING SYSTEM AND METHODS

(71) Applicant: J.F. Brennan Company, Inc., La Crosse, WI (US)

(72) Inventors: Greg Smith, La Crosse, WI (US); Randy Jacobs, La Crosse, WI (US); Dustin Bauman, La Crosse, WI (US); Victor J. Buhr, La Crosse, WI (US); Adam Thorson, La Crosse, WI (US); Justin Scherf, La Crosse, WI (US)

(73) Assignee: J.F. Brennan Company, Inc., La Crosse, WI (US)

( * ) Notice: Subject to any disclaimer, the term of this patent is extended or adjusted under 35 U.S.C. 154(b) by 272 days.

(21) Appl. No.: 16/320,628

(22) PCT Filed: Aug. 12, 2016

(86) PCT No.: PCT/US2016/046685

§ 371 (c)(1),
(2) Date: Jan. 25, 2019

(87) PCT Pub. No.: WO2018/031028

PCT Pub. Date: Feb. 15, 2018

(65) Prior Publication Data

US 2019/0161150 A1 May 30, 2019

(51) Int. Cl.
*B63C 11/52* (2006.01)
*E02F 3/88* (2006.01)
(Continued)

(52) U.S. Cl.
CPC ..... *E02F 3/9243* (2013.01); *B63C 11/52* (2013.01); *E02F 3/885* (2013.01); *E02F 3/8825* (2013.01); *E02F 3/8816* (2013.01); *E02F 9/06* (2013.01)

(58) Field of Classification Search
CPC ..... E02F 3/88; E02F 3/90; E02F 3/92; E02F 3/902; E02F 3/905; E02F 3/9212; B63C 11/52
See application file for complete search history.

(56) References Cited

U.S. PATENT DOCUMENTS 165,035 A 6/1875 Smith
703,817 A 7/1902 Perry
(Continued)

FOREIGN PATENT DOCUMENTS

EP 0592268 A1 4/1994
JP 63-255195 A 10/1988

*Primary Examiner* — Thomas B Will
*Assistant Examiner* — Joan D Misa
(74) *Attorney, Agent, or Firm* — Husch Blackwell LLP

(57) ABSTRACT

A dredge head assembly is disclosed. The assembly includes: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver. Dredging systems and methods of dredging are also disclosed.

8 Claims, 11 Drawing Sheets

(51) Int. Cl.
*E02F 3/92* (2006.01)
*E02F 9/06* (2006.01)

(56) References Cited

U.S. PATENT DOCUMENTS 906,234 A * 12/1908 Jackson ..... E02F 3/905 251/345
974,150 A * 11/1910 Hunter ..... E02F 3/905 15/314
1,719,668 A 7/1929 McEachern
1,964,951 A 7/1934 Kertzman
2,028,580 A * 1/1936 Yedd ..... B25D 17/02 175/6
2,096,595 A 10/1937 Sanford
2,605,090 A 7/1952 Jacobsen
3,283,516 A 11/1966 DeLong et al.
3,808,779 A * 5/1974 Randall ..... A01D 44/00 56/9
4,018,483 A * 4/1977 Smith ..... B65G 53/42 15/409
4,352,251 A 10/1982 Sloan
4,423,559 A * 1/1984 Malin ..... F16L 27/04 15/410
4,807,373 A 2/1989 Sloan et al.
4,854,058 A * 8/1989 Sloan ..... E02F 3/88 37/323
5,100,261 A * 3/1992 Plemon ..... B63C 11/04 126/204
5,129,167 A * 7/1992 Nakahara ..... E02F 3/925 37/318
5,944,447 A 8/1999 Wyatt
5,970,635 A * 10/1999 Wilmoth ..... E02F 3/925 37/333
6,484,668 B2 * 11/2002 Riverin ..... E02F 7/065 119/201
6,499,239 B1 * 12/2002 Van Berk ..... E02F 3/88 37/195
7,334,358 B1 * 2/2008 Whyte ..... E02F 3/8891 37/324
7,484,322 B2 * 2/2009 Maybury, Jr. ..... E02F 5/003 406/88
7,695,215 B2 4/2010 Buhr et al.
7,721,472 B2 5/2010 Buhr et al.
7,793,442 B2 9/2010 Koch et al.
8,863,413 B2 10/2014 Goodin
2008/0172911 A1 7/2008 Buhr et al.
2012/0012276 A1 * 1/2012 Von Herzen ..... F24T 10/30 165/45
2012/0085003 A1 * 4/2012 Goodin ..... E02F 3/9243 37/317
2012/0198733 A1 8/2012 Winkelman et al.
2012/0216435 A1 8/2012 Wen

* cited by examiner

DREDGE HEAD ASSEMBLY AND RELATED DIVER-ASSISTED DREDGING SYSTEM AND METHODS

FIELD OF THE INVENTION

The present invention relates to the removal of sediment from underwater environments. In one aspect, the invention relates to the removal of fine, contaminated sediment from water bodies, including marine, riparian and lake environments. In another aspect, the invention relates to the use of a diver assisted dredging method and system for the removal of the sediment, while in still another aspect, the invention relates to such dredging methods and systems when used to accomplish dredging near utilities, or other underwater obstacles or objects. In another aspect, the invention relates to a dredge head attachment, while in still another aspect, the dredge head is used in such systems and methods.

BACKGROUND OF THE INVENTION

Sediment removal from the bottom of natural and artificial bodies of water falls broadly into one of two camps, i.e., navigational and environmental. The primary purpose of the former is to create and/or maintain bodies of water open for navigation while the primary purpose of the latter is to remove sediment considered a threat to public health from a body of water.

Contaminated sediments can be removed by a number of different methods. One method is mechanical dredging using a modified clamshell bucket. These buckets use positioning devices to locate and extract sediment one bucket at a time. This method produces good results, but can be, and often is, time, equipment and manpower intensive.

Another method is hydraulic dredging which is commonly used in areas of shallow water. This is a more efficient means of removing material, but it often requires multiple passes to achieve designated decontamination levels. This method typically employs a cutter head or a horizontal auger to aid in the removal of these sediments.

The cutter head dredge has advantages over the auger dredge due to its ability to follow contours when possessing articulating and swinging capabilities. This is an efficient and effective way to remove material, eliminating the need for dredge swing line anchors. The horizontal auger also has its strengths. The auger can cover a wide swath of area at any given time, and to some degree, follow contours. However, large materials and debris can be very problematic for an auger due to the large distance materials must travel from the end of the auger to the suction pipe.

Both the cutter head and horizontal auger have difficulties when such are used to in dredging near pipelines, utilities, or other underwater obstacles or objects. In particular, locating and/or avoiding underwater obstacles can slow dredging production considerably. In the past, utility cables and other underwater obstacles were generally located, meaning the locations were estimated with some level of precision. Based on those estimates, dredging positions were established using a stepping back an amount (e.g., approximately 100 feet away on either side of a line). However, this stepping back left large regions still requiring dredging so as to remove contaminants.

Dredging near obstacles also generally has included a number of risks. First, even with stepping back, cutter head dredges use a large agitating device that can potentially damage obstacles, which is a particular problem when dredging around or near pipelines and utilities. Further, some dredges use a spud system to anchor/move the dredge into positions while dredging. While the dredges (e.g., cutter head) can be accurately positioned, spuds typically have more of a range when positioning. Anchoring too close to an obstacle can therefore be problematic.

Diver-assisted or diver-aided dredging has also been attempted to increase efficiency of dredging near and/or around obstacles, and particularly pipelines and utilities. Typically, such systems required a diver to assemble a first length of hose underwater (typically 10 feet), activate the dredge pump, dredge a section (e.g., the section within reach of the hose), deactivate the pump, assemble a second length of hose to the first length of hose (typically resulting in a 20-foot length of hose), activate the dredge pump, dredge another section (e.g., the section now within reach of the extended hose), and so on until the total area was dredged. Similarly, such systems may operate in "reverse," with a long or multi-section hose with dredging initiated at a distance away from a dredging vessel and divers moving towards the dredging vessel. As dredging progresses, divers guide the dredging assembly and the hose is disconnected or coiled as less length is needed. Such systems, while avoiding utilities and other obstacles, are typically slower and less inefficient due to the amount of work necessary between dredging sections and diver fatigue. For example, such systems typically have a dredge speed of up to 5 yards per hour per diver.

Therefore, it would be desirable to provide an improved dredge head assembly, dredging system and/or dredging method that could be developed that would facilitate dredging over the top of pipelines, utilities or other underwater obstacles (which may be buried or underground), bypassing or avoiding such obstacles, and still maintain a high dredging production rate relative to conventional dredging systems/methods.

SUMMARY OF THE INVENTION

In accordance with at least one aspect of the invention, a dredge head assembly is disclosed. The dredge head assembly includes: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver.

In accordance with at least another aspect of the invention, a diver assisted dredging system is disclosed. The system includes: a dredge head assembly comprising: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver; and a towing assembly comprising a dredge head support assembly, wherein the dredge head assembly is connected to and suspended from the dredge head support assembly.

In accordance with at least another aspect of the invention, a diver assisted dredging system is disclosed. The system includes: a guide barge; a dredging vessel comprising a dredge head support assembly; a towing assembly in communication with the guide barge and dredging vessel, the towing assembly configured to reposition the dredging vessel relative to the guide barge; and a dredge head assembly connected to the dredge head support assembly of the dredging vessel by a flexible hose, the dredge head assembly comprising dredge head assembly comprising: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver.

And in accordance with at another aspect of the invention, a diver-assisted method of dredging is disclosed. The method includes: providing a dredging system comprising a towing assembly and a dredge head assembly, wherein the dredge head assembly is connected, directly or indirectly, to the towing assembly and wherein the dredge head assembly comprises a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver; and using the dredging system to accomplish dredging in an area to be dredged.

Advantageously, highly efficient and effective dredging systems and methods are provided herein, particularly when such dredging methods and systems are used to accomplish dredging near utilities, or other underwater obstacles or objects.

Various other aspects, objects, features and embodiments of the invention are disclosed with reference to the following specification, including the drawings.

Notwithstanding the above examples, the present invention is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. In the drawings.

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components. In the drawings.

DETAILED DESCRIPTION

Figure 1:
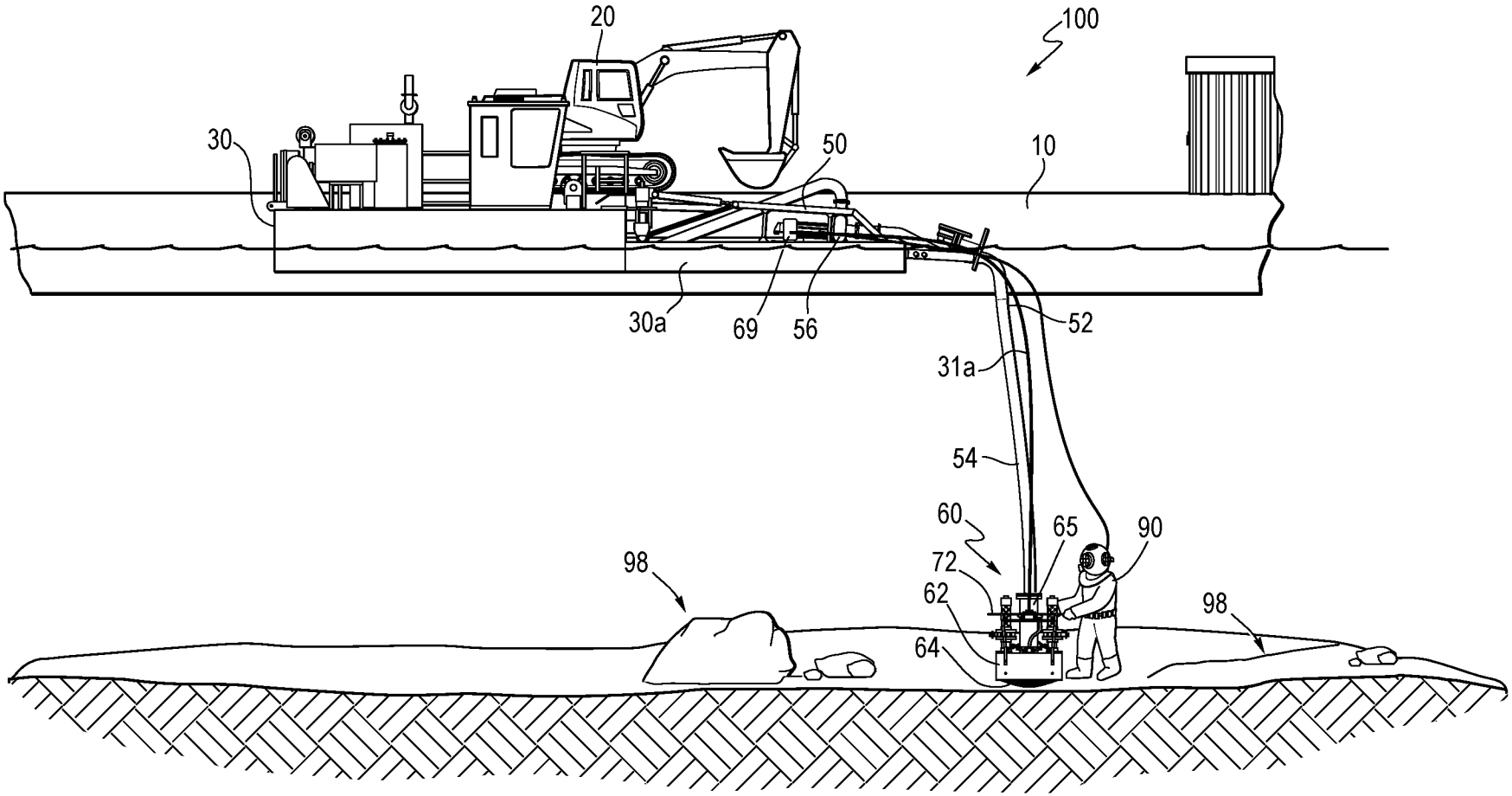
FIG. 1 is a side plan view of one embodiment of a diver assisted dredging system, including a guide barge, a towing assembly, a swinging arm, a ladder, and connected dredge head assembly, in accordance with embodiments of the present disclosure.

A diver-assisted dredging system 100 for use in avoiding underwater utility cables, pipes, conduits and other underwater obstacles and related methods are provided herein.

Diver Assisted Dredging System and Dredge Head Assembly

Dredging is used to remove sediment from water bodies, and in some instances, the sediment may be contaminated. Much of the contamination found in underwater environments is in the form of fine sediments and if disturbed, these sediments are easily suspended in the overlying water. Even when not contaminated, disruption of find sediments creates visibility problems in underwater environments and can cause harmful or detrimental effects on the environment/ecosystem. In a contaminated sediment removal operation particularly, the suspension of fine sediment is a common cause of the redistribution of the contaminated sediment.

Cutter heads and auger dredges are well known for churning up the sediment layers and as such, are not well adapted for removing sediment. The dredge head assembly 60/60' of this invention reduces suspended solids as well as directs these solids into the dredge head assembly 60/60' through the use of, among other things, a shroud 62/62'. The system 100 of this invention removes the light sediments without inadvertently disturbing underlying sediments such as sand, gravel and clay. Instead, depending on the characteristics of the materials, the suction effects can be adjusted to remove primarily or only the intended sediments, while limiting any suspension due to their removal by avoiding contact with the material.

Turning now to the Figures, FIGS. 1, 2A, 2B, 2C and 12 show embodiments of a diver-assisted dredging system 100 according to embodiments of the present disclosure. In the embodiments shown, the system 100 includes a dredge head assembly 60 connected, directly or indirectly, to a towing assembly 20 which is configured to move the dredge head assembly 60 a distance with respect to a water body, with a diver 90 further guiding the dredge head assembly 60 with respect to underwater obstacles 98.

Figure 2A:
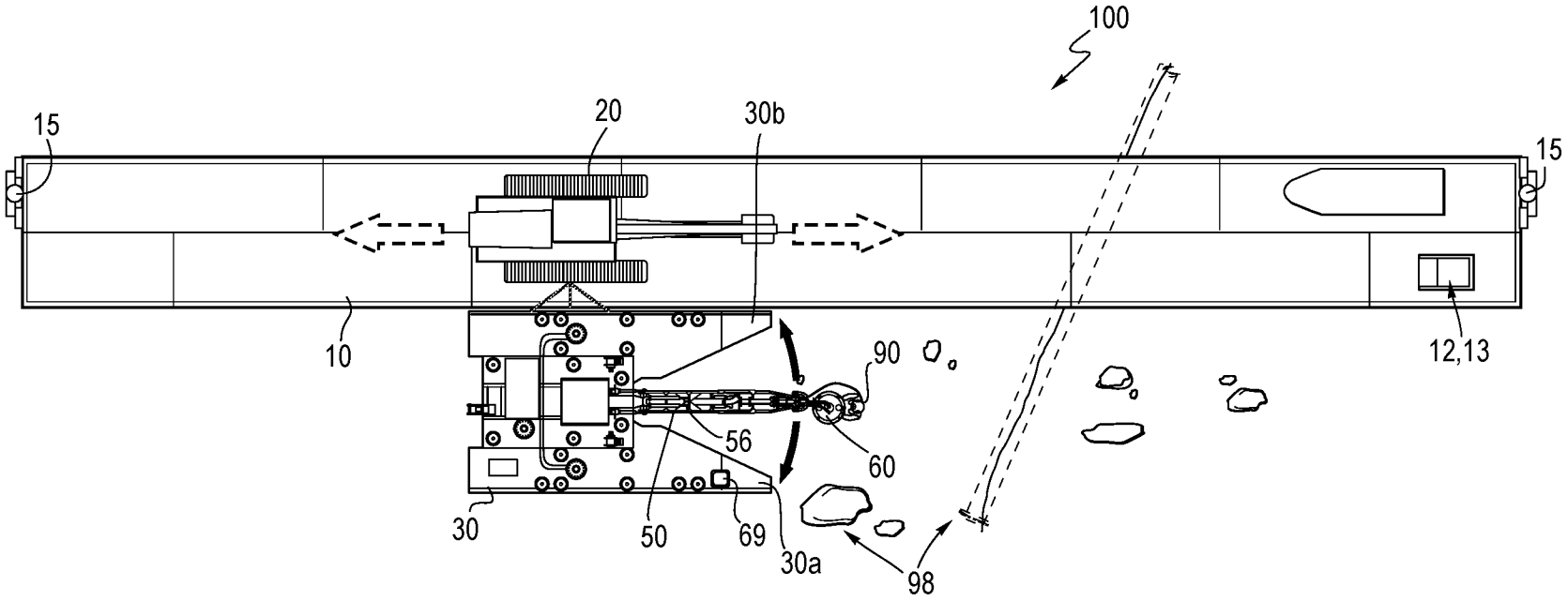
FIG. 2A is a top plan view of the system of FIG. 1.
Figure 12:
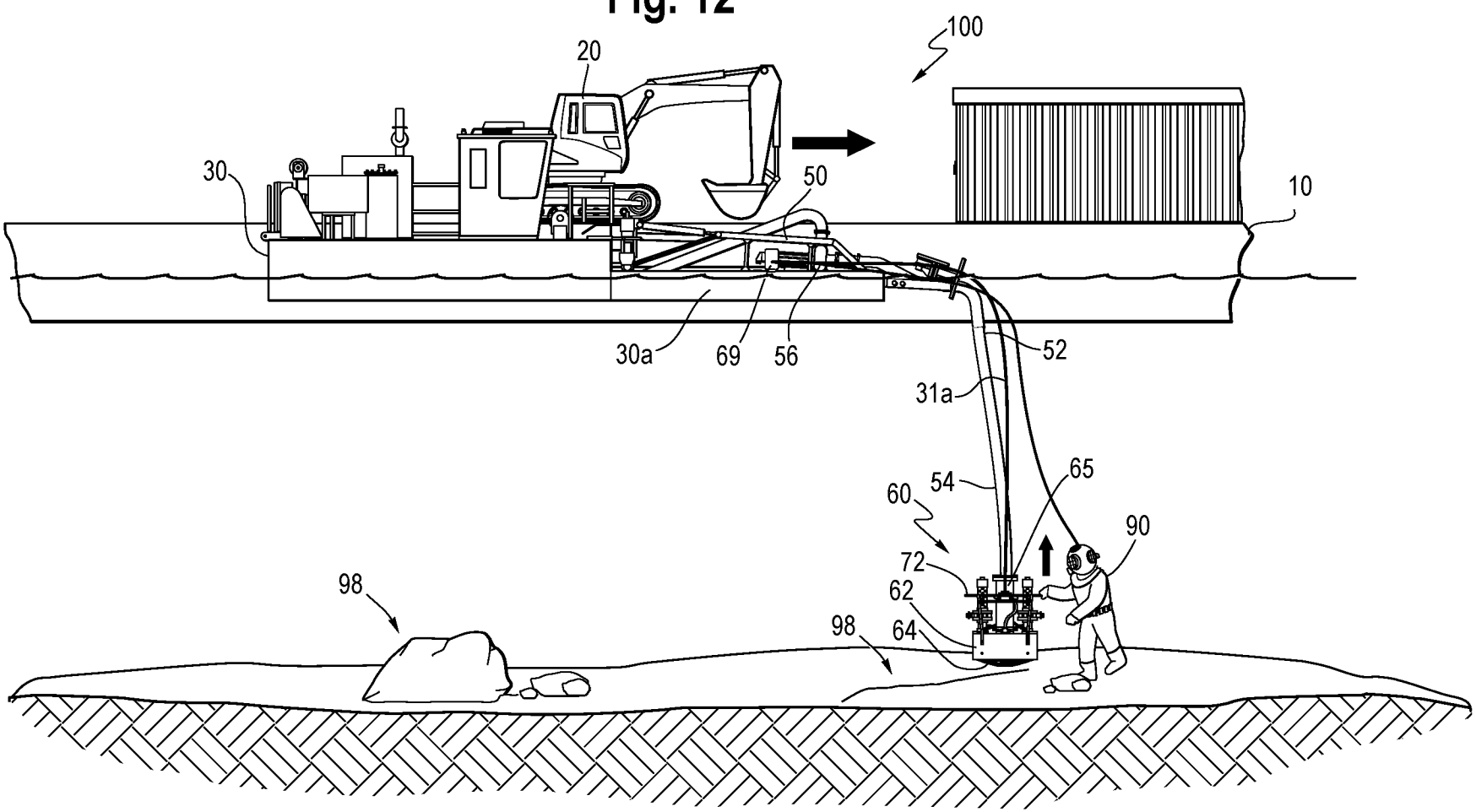
FIG. 12 is a side view schematic of diver assisted dredging system, similar to that of FIG. 1, showing the dredge head assembly being manipulated by a diver to accomplish dredging near underwater obstacles or objects (as shown a pipeline), in accordance with embodiments of the present disclosure.

With reference to FIGS. 1 and 2A, in particular, there is show a first embodiment of a diver-assisted dredging system 100 according to embodiments of the present disclosure, with FIG. 12 showing an embodiment of the diver-assisted dredging system 100 in use with a diver 90 guiding the dredge head assembly 60 over an obstacle 98. In the embodiment shown, the dredge head assembly 60 is indirectly connected to the towing assembly 20 via a dredging vessel 30 containing a dredge head support assembly 50. Specifically, the system 100 shown in FIGS. 1, 2A and 12 includes a guide barge 10, an towing assembly 20, a dredging vessel 30 alongside the guide barge 10 and having a dredge head support assembly 50, and a connected dredge head assembly 60.

The guide barge 10 is anchored using the positioning device(s) 15 and used to establish a reference location. The towing assembly 20 is movable on the barge 10. The dredging vessel 30 is tethered or otherwise connected to the towing assembly 20 on the guide barge 10. Movement of the towing assembly 20 on the guide barge 10 (e.g., in a forward or backwards direction) controls the movement of the dredging vessel 30 alongside the guide barge 10 and at a desired pace. In embodiments the towing assembly 20 can move or otherwise cause movement of the dredging vessel 30 in a side-to-side manner to bring the dredging vessel 30 closer to the guide barge 10 or allow more freedom between the dredging vessel 30 and the guide barge 10.

In accordance with some embodiments, the towing assembly 20 is configured to move the dredging vessel 30 in 2-3 foot increments along the guide barge 10. In an embodiment, this movement may be automatically controlled. In other embodiments, a visual aid is provided (e.g., floor markings, toe board markings, etc.) along the guide barge 10 to permit an operator to move the dredging vessel 30 the proper increment. Specifically, in the embodiment shown, the towing assembly 20 is configured to travel along the length of the guide barge 10, thereby towing the dredging vessel 30 alongside the guide barge 10. In such an embodiment, the driver of the towing assembly 20 may use visual markings providing on the floor, rail, toe board or other structure which extends the length of the guide barge 10 to move the dredging vessel 30 the appropriate increment.

In an embodiment, the dredge head support assembly 50 is a ladder. In some embodiments, the dredge head support assembly 50 is a stationary ladder. In other embodiments, the dredge head support assembly 50 is a swinging ladder. In some embodiments, such as, for example, referring in particular to FIG. 2A, the dredge head support assembly 50 may be part of the dredging vessel 30. In the embodiment shown in FIG. 2A, for example, the dredging vessel 30 is a dredging vessel such as one commonly employed with a cutterhead, but having the cutterhead removed from the ladder 50 and a hose 54, such as a flexible hose, connected to dredge pump 56.

In embodiments in which the dredge head support assembly 50 is a stationary ladder, a diver 90 may move the dredge head assembly 60 to the extent permitted by the hose 54 (described more fully below) to dredge an area underwater which is wider than just directly underneath the end of the dredge head support assembly 50. In other embodiments, particularly those in which the dredge head support assembly 50 is a swinging ladder, in order to dredge the total area permitted by the system 100 when the dredging vessel 30 is at a position (between increment movements), the dredge head support assembly 50 swings between the legs 30*a*/30*b* of the dredging vessel 30 to complete at least one full swing before the dredging vessel 30 is moved another increment.

The guide barge 10 can itself be moved in a controlled manner to guide the dredging vessel 30 so that material can be removed from a waterway bed in a controlled manner about a desired location. A diver or team (squad) of divers 90 assists in controlling the dredge head assembly 60 (which sometimes can be referred to as a "suction head") of the dredging vessel 30 underwater and aid in avoiding the underwater obstacles (e.g., utility cables, pipes, etc.).

Referring in particular to FIGS. 1 and 2A, the guide barge 10 includes at least one positioning device 15, a fuel tank 12, and a barge movement means 13, e.g., engine, and is releasably engaged with the dredging vessel 30 while dredging is occurring. Movement of the guide barge 10 is accomplished by barge movement means 13, which in the exemplary embodiment shown is an engine.

The guide barge 10 and dredging vessel 30 float on a water body surface. While the barge 10 and dredging vessel 30 are on the water body, the positioning device(s) 15, when deployed, prevent the barge 10 and dredging vessel 30 from laterally moving across the water body. In at least one embodiment, the positioning device(s) 15 is/are positioning spud(s).

In an embodiment, the guide barge 10 has a length which is calculated based on the underwater obstacles in the dredging location. For example, in order to avoid damaging a utility, obstacle, or, in some cases, the dredging system 100 itself, a clearance between any positioning device 15 and an obstacle is 25 feet. Therefore, if there is only one obstacle, the minimum length of a guide barge 10 is 50 feet. At 50 feet, the barge 10 will need to straddle the obstacle/utility at the center of the barge 10, resulting in the positioning device 15 being located at 25 feet in either direction from the obstacle.

If more than one obstacle or utility is present, the length of the barge 10 is determined by the largest span of obstacles (e.g., longest distance between utilities). An additional length of 50 feet, at a minimum, is added to that distance to eliminate any positioning device 15 (e.g., spud) being located closer than 25 feet to a given utility.

In the embodiment shown, the towing assembly 20 is a towing vehicle, such as an excavator. However, in further embodiments, the towing assembly 20 may be a winching system, or other similar assembly or system.

In the exemplary embodiment shown, the hose 54 hangs vertically, or generally or substantially vertically, and downwardly from the dredge head support assembly 50, and specifically the dredge intake 52 at the end of the dredge head support assembly 50, as shown in FIGS. 1 and 12. In this configuration, the dredge head support assembly 50 supports the weight of the dredge head assembly 60. Further, in embodiments in which the dredge head support assembly 50 moves in a swinging fashion during dredging (described in further detail below), the vertically hanging flexible hose 54 provides a cushioning effect if the dredge head assembly 60 comes in contact with the water body bottom, a utility or other obstacle. As will be appreciated, the length of the hose 54 therefore varies depending on the depth of the water body being dredged. The length of the hose 54 is also designed to allow the diver(s) 90 some maneuverability of the dredge head assembly 60 underwater. In an embodiment, for example, the hose 54 provides enough slack that the diver(s) 90 can move the dredge head assembly 60 up to a 2-foot radius from the end of the dredge head support assembly 50, and preferably up to only a 1-foot radius from the end of the dredge head support assembly 50.

Connecting the dredging vessel 30 to the dredge head assembly 60 using a flexible hose 54 allows the dredge head assembly 60 to better follow the contours of the sediment models (e.g., contaminated sediment models) to efficiently and cost-effectively extract fine granule sediments while leaving the heavier (and potentially non-contaminated) material in place.

Figure 2B:
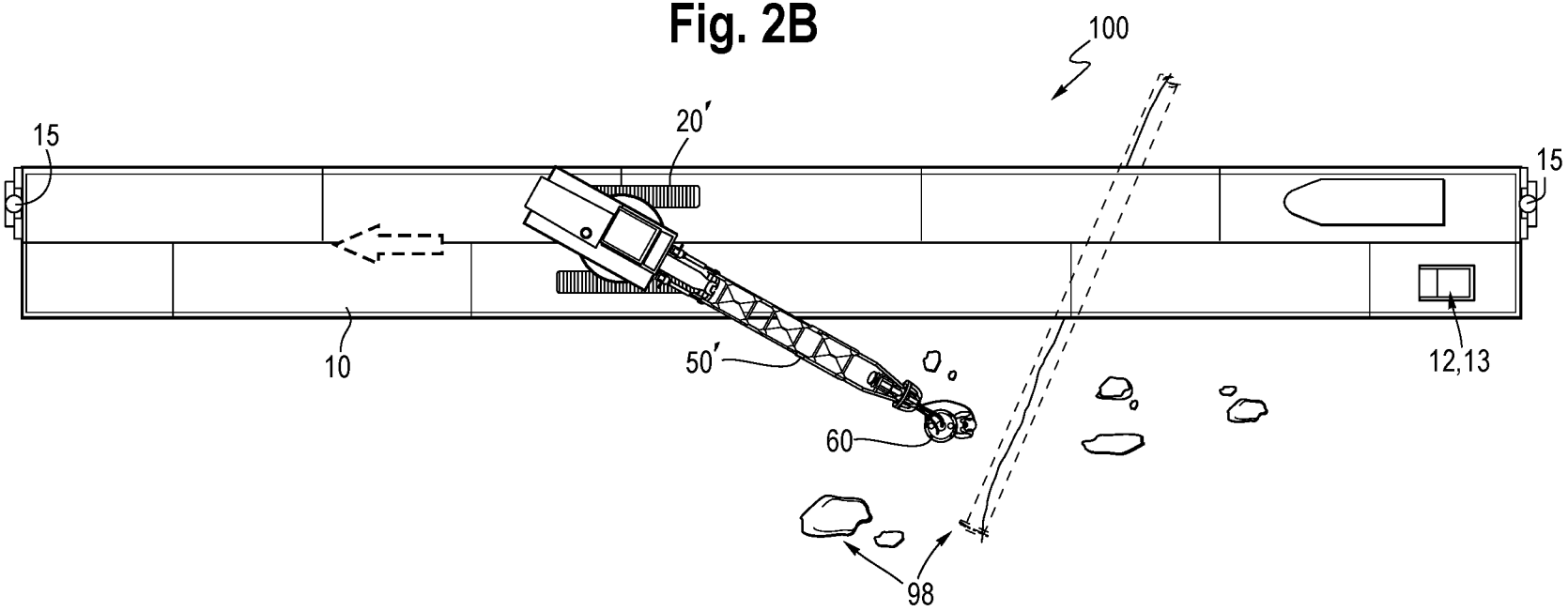
FIG. 2B is a top plan view of a second embodiment of a diver assisted dredging system including a guide barge and a dredge head assembly connected to and suspended from a towing assembly.
Figure 2C:
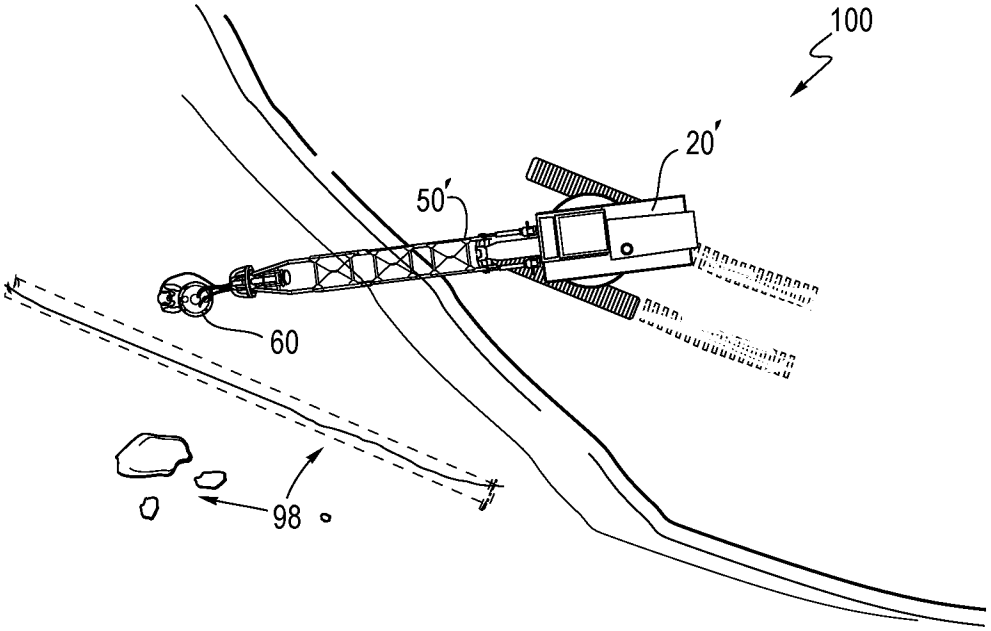
FIG. 2C is a top plan view of a third embodiment of a diver assisted dredging system including a dredge head assembly connected to and suspended from a towing assembly.
Figure 3:
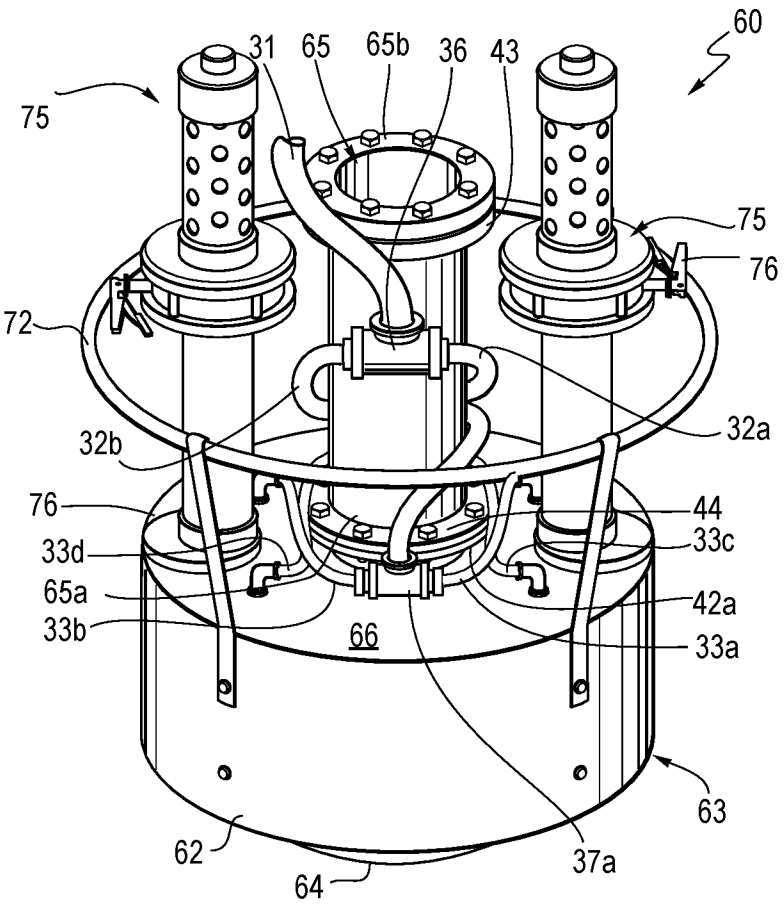
FIG. 3 is an enlarged top perspective view of a first embodiment of a dredge head assembly for use with the diver assisted dredging system of FIG. 1 and in accordance with embodiments of the present disclosure.

In further embodiments, such as shown, for example, in FIGS. 2B and 2C, for example, a dredge head assembly 60 is connected directly to a towing assembly 20' which includes a dredge head support assembly 50'. With reference to FIG. 2B, specifically, an embodiment of a diver-assisted dredging system 100 includes a guide barge 10 and a dredge head assembly 60 connected to and suspended from a towing assembly 20'. In other words, the embodiment in FIG. 2B does not use a dredging vessel and instead suspends the dredge head assembly 60 directly from the towing assembly 20', with the towing assembly 20' configured to move, or tow, the dredge head assembly 60 at least a portion of the length of the guide barge 10. Similarly, FIG. 3 shows a further embodiment of a diver-assisted dredging system 100 which omits a guide barge 10. The towing assembly 20' is instead provided directly on the shore or dock of a water body and configured to suspend the dredge head assembly 60 into the water and move at least a distance along the water body. In such embodiments, the towing assembly 20' may be considered to have a dredge head support assembly portion 50' (e.g., the extension to which the dredge head assembly 60 is attached, e.g., via a flexible hose 54). Further, in such embodiments, and as shown in FIGS. 2B and 2C, the towing assembly 20' is a crane or boom-like assembly; however, other structures, vehicles and assemblies capable of suspending and towing a dredge head assembly 60 for a length may be used.

By eliminating the dredging ship 30 and/or guide barge 10 and using a towing assembly 20' with a dredge head support assembly portion 50', the dredge head assembly 60 may be deployed in harder to reach/access locations which could otherwise be at least partially inaccessible or difficult to reach if additional space was required to deploy the dredging ship 30 and/or guide barge 10. For example, and specifically with reference to FIG. 2C, by eliminating the guide barge 10 and dredging vessel 30, the dredge head assembly 60 can be deployed nearer a shoreline or water body edge (e.g., such as, for example, if dredging near a break wall, etc.).

The system 100 further includes a dredge head assembly 60. In accordance with embodiments of the present invention, the dredge head assembly 60 is used to extract a wide range of sediment sizes, ranging from gravel size (e.g., 8 millimeters) and greater (e.g., small rocks/debris) all the way down to clay size (e.g., 0.06 micrometers), from the bottom of water bodies while having minimal impact on the surrounding aqueous environment. In a further embodiment, the dredge head assembly 60 is used to extract sediment of at least 0.06 micrometers. In a further embodiment, the dredge head assembly 60 is used to extract sediment of up to 8 millimeters, or up to 1 inch, or up to 2 inches, or up to 3 inches.

While FIGS. 1 and 2 show only a single diver 90, other embodiments of the system 100 may include a team or squad of divers. In some embodiments, the diver(s) 90 may scout, map or otherwise inspect the area to be dredged prior to deploying any diver-assisted dredging system 100. The diver(s) may look for the types, location and size of various underwater obstacles and relay that information (either via communications device while underwater or upon return to the surface) to a crew member who stays above water during the dredging process. In other embodiments, the diver(s) scout, map or otherwise inspect the area to be dredged as dredging operations proceed (i.e., "in real time").

Figure 5:
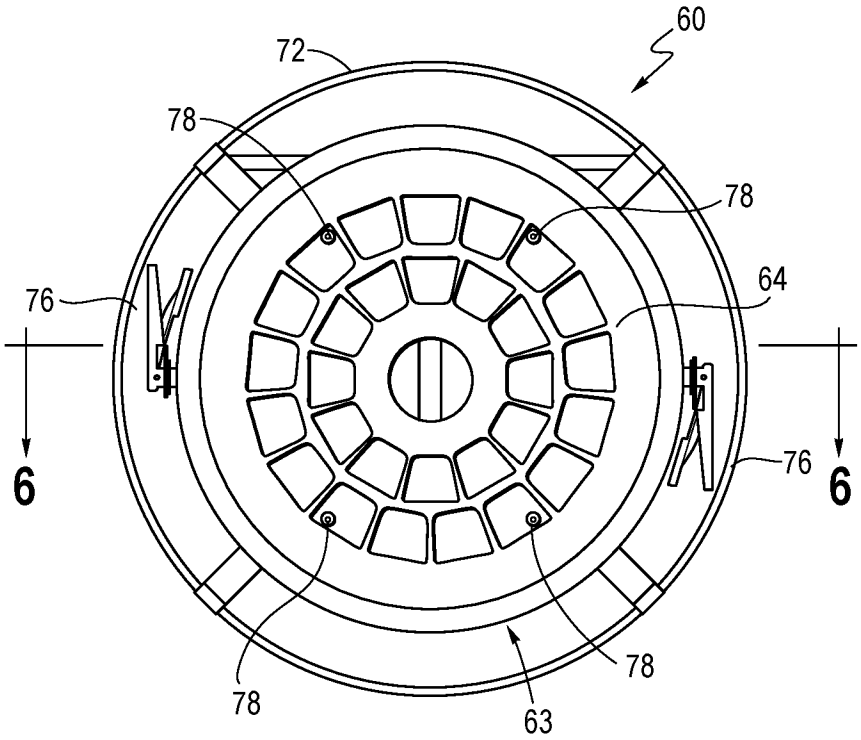
FIG. 5 is a bottom perspective view of the dredge head assembly of FIG. 3.
Figure 4:
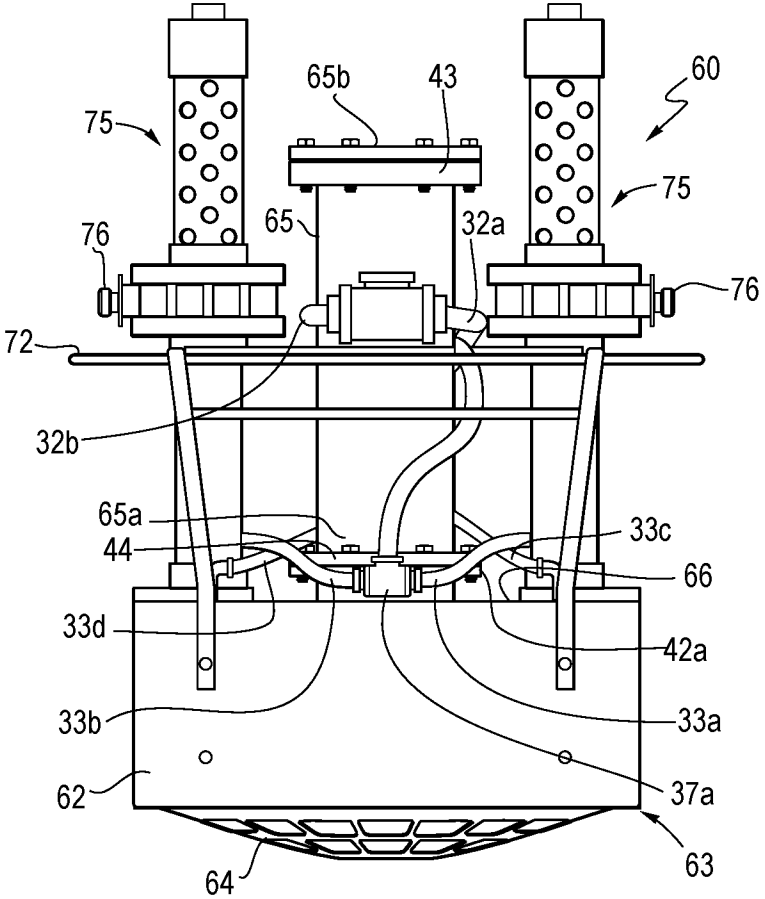
FIG. 4 is a side view of the dredge head assembly of FIG. 3.

Referring now to FIGS. 3-5, the dredge head assembly 60 is configured or structured for use by a diver or team of divers. The dredge head assembly 60 of this invention is used to extract fine sediments, including contaminated fine sediments, form the bottom of water bodies (e.g., marine, river, lake and canal bottoms). The dredge head assembly 60 increases the rate at which such water bodies can be suction dredged by increasing the efficiency at which material can be extracted, particularly from areas containing underwater utilities and/or other obstacles. Suction dredge systems using the dredge head assembly 60 described herein can cover more area in a specified amount of time while achieving a more successful end result in dredging, and particularly contamination clean-up dredging. The dredge head assembly 60 also reduces the cost of dewatering and disposing of sediments by reducing the amount of untargeted uncontaminated) sediments that are inadvertently removed (e.g., when using cutter head or auger dredges).

The dredge head assembly 60 also increases the efficiency and rate of production as compared to current diver-assisted/aided dredging solutions. Current diver-assisted/aided dredging solutions required divers to assemble lengths of hose underwater, as described previously, resulting in an average efficiency (dredge rate) of up toy yards per hour per diver. In the current system 100, the dredge head support assembly 50 carries a majority of the weight of the dredge head assembly 60 and also moves the dredge head assembly 60 the width of a dredging lane. The guide barge 10/towing assembly 20/dredging vessel 30 configuration also means that a diver does not have move the dredge head assembly 60 the length of a dredging channel or otherwise assemble hose sections underwater.

In the embodiments shown, the dredge head assembly 60 includes a shroud 62 which in the embodiment shown is a cylindrical body having a bottom end 63 that is generally open, but covered by a screen structure or gatling plate 64, and a suction tube or pipe 65 connected to a top end 66 (e.g., such as by bolts) which connects to a flexible hose, pipe or other conduit 54 which runs up to the dredge ship 30, and specifically to the dredge pump 56 that induces suction. The shroud 62 and top end 66 (sometimes referred to as a "head plate") may be connected using any convenient means, e.g., welding, mechanical fasteners like screws or bolts, etc.

In an embodiment, the shroud 62 has a diameter of approximately 30-inches; however, the footprint of the shroud 62 can vary to convenience and is dependent, in large part, on the size of the dredging vessel 30 to which the dredge head assembly 60 is attached. For example, one size particularly useful in remediating river bottoms measures about 0.775 meters (m, or 30.5 inches (in)) in diameter for a total enclosed area of approximately 0.47 square meters ($m^2$, or 5.1 square feet ($ft^2$)).

In embodiments, the shroud 62 has a robust thickness of approximately 1.27 centimeters (cm, or 0.5 in) to provide it with durability in underwater debris encounters. The shape/configuration of the shroud 62 can also vary widely, e.g., polygon, circle, oval, etc., with a circle or oval configuration preferred. As shown in the present Figures, for example, in an embodiment, the shroud 62 has a cylindrical body with a 30.5 inch diameter.

The height of the shroud 62 may also vary to convenience but with the diameter, thickness and configuration previously described, a height of approximately 19.4 cm (7.6 in) to 30.48 cm (12.0 in) keeps the suction pipe sufficiently spaced off of or away from the layers of sediment to reduce the potential for catching debris and pump cavitation.

The shroud 62 can be made of any suitable materials, e.g., rubber, metal, plastic, etc. In an embodiment, the shroud 62 is made of a polymeric material, such as a high density polyethylene (HDPE). In an embodiment, HDPE is preferred because it is neutrally buoyant in freshwater. While the overall dredge head assembly 60 may be negatively buoyant in freshwater, using a material which is, generally, neutrally buoyant, like HDPE, mitigates the extent to which the dredge head assembly 60 is negatively buoyant, thereby making it easier for a diver or dive team to maneuver the dredge head assembly 60 underwater. However, in further embodiments, the dredge head assembly 60 itself may be neutrally buoyant.

In addition to protecting components of the dredge head assembly 60, the shroud 62 is used to accomplish at least two further purposes in the function of the dredge head assembly 60. One purpose is to surround or engulf most, if not all, solid particles placed into suspension during the removal operation. This reduces the area affected by dredge operations by controlling the re-settlement of suspended solids and also reduces the amount of solids suspended in the water around the work area. The second purpose is to help direct the suspended solids into the suction pipe 65.

According to embodiments of the present invention, the suction tube or pipe 65 is connected at a first end 65*a* to the top end 66 of the shroud 62 and at a second end 65*b* to the flexible hose, pipe or other conduit 54 (see FIGS. 1-2) which is, in turn, connected to the vacuum-generating unit 56 (e.g., dredge pump) on the dredging vessel 30. As shown specifically at FIGS. 3-4, the suction pipe 65 includes an bottom flange 44 which is bolted or otherwise connected to a flange 42*a* on the top end 66 of the shroud 62. The suction pipe 65 further includes a top flange 43 which is bolted or otherwise connected to a flange 42*b* on the bottom end of the flexible hose 54 (see FIGS. 9 and 10).

In the embodiment shown, the vacuum-generating unit 56 ("dredge pump") is located on the dredge head support assembly 50, but it can be located at any convenient location on the dredging vessel 30.

Generally, the suction pipe 65 is located as close to the center of the shroud 62 as possible to create a consistent suction effect through its enclosed area.

As will be appreciated, the suction pipe 65 is in open communication with the top end 66 of the shroud 62, i.e., the top end 66 does not block the flow of sediment from the bottom of the water body into the suction pipe 65. In a preferred embodiment, the suction pipe 65 has a fish-mouth end (not shown) for receiving sediment, and this design facilitates placement of the suction pipe 65 as close to the center of the shroud 62 as possible. The fish-mouth shaped end of the suction pipe (not shown) is mated and welded or otherwise fastened over a fish-mouth shaped opening in the top end 66 of the shroud 62.

In accordance with an exemplary embodiment, the design, size and materials of construction of the suction pipe 65 and flanges 43, 44 can vary as desired. Typically, however, for the current use, the suction pipe 65 has a minimum pressure rating of 10.34 bar (150 pounds per square inch (psi)).

In an embodiment, the shroud 62 is equipped with several features to facilitate handling, safety and agitation, including, but not limited to, the screen structure or gatling plate 64, one or more handles 72, water jet nozzles 78, and one or more vacuum relief valve assemblies 75.

The screen structure or gatling plate 64 protects the interior components of the dredge head assembly 60 and prohibits large rocks and debris from being caught in the dredge pump 56 and/or suction pipe 65. Gatling plates 64 are common industry practice, and the gatling plate 64 acts as a screen allowing only materials of a designated size to be removed. Particularly, in the embodiment shown, the screen structure or gatling plate 64 has openings of approximately 3 inches by 3 inches. While in the embodiment shown, the gatling plate 64 includes two rings of openings, more or fewer openings may be provided in the gatling plate 64, and openings may have different shapes or geometries. The number, positioning, and geometry of the openings may vary depending on preference, design, and/or anticipated dredging conditions, among other factors. Particularly, in some embodiments, openings may be provided only at or about the circumference of the gatling plate 64. As will be appreciated, a majority of the suction will occur where the sediment is agitated, which will be near the nozzles 78. By providing openings in locations at or about the circumference of the gatling plate 64, which also corresponds to the location of the nozzles 78, dredging efficiency may be improved.

In the embodiment shown the gatling plate 64 is a stationary (fixed) plate. However, in further embodiments, a gatling plate may be rotated (e.g., by a hydraulic motor) to keep debris from collecting around the mouth of the suction pipe which generally results in pump cavitations. In embodiments in which the gatling plate rotates, a gatling shear may be attached to the shroud 62 opposite the suction pipe 65 opening. The shear frees accumulated sediments or materials that collect on the plate to avoid pump cavitation. The shear may be fastened to the shroud 62 using a series of six bolts in which a manner that minimal space, e.g., 0.32 cm or 0.125 inches, exists between a gatling plate (typically rotating) and the shear (fixed).

According to embodiments of the present invention, the screen structure or gatling plate 64 is made of a material of sufficient strength and thickness to operate in the underwater environment in which it is deployed. In an embodiment, for example, a gatling plate 64 measures 0.6 m (2 ft) in diameter and is made from 1.9 cm (0.75 inch) thick T-1 plate.

According to embodiments of the present invention, the dredge head assembly 60 includes a plurality of water jet nozzles 78. In the embodiment shown in FIGS. 3-5, the nozzles 78 are housed within the shroud 62 near the screen structure 64. The nozzles 78 may be positioned as desired within the shroud 62, but generally the water jet nozzles 78 will be positioned to aim downwardly and outwardly to direct water outwardly through the screen structure 64 to agitate the sediment beneath the shroud 62 for more efficient dredging.

In the embodiment shown, with specific reference to FIG. 5, the nozzles 78 are circumferentially positioned and evenly spaced around the openings of the screen structure 64. While the embodiment shown includes four nozzles 78, any number of nozzles could be provided. In further embodiments, nozzles 78 may be provided in one or two rings coaxial with the suction tube or pipe 65. In other embodiments, the nozzles 78 may be positioned on a generally ring-shaped pipe ("jetting ring") attached to the outside of the shroud 62 near the lower end 63 of the shroud 62.

Particularly in the embodiment shown, the nozzles 78 are positioned as outwardly from the center of the dredge head assembly 60 as possible while still being positioned with respect to an opening in the screen structure 64 such that water from the nozzles 78 exits the shroud 62. Further as shown, the nozzles 78 are aimed outwardly from the center of the dredge head assembly 60, and in further embodiments, the angle of the nozzles e.g., extent to which the nozzles 78 aim outwardly/inwardly/straight down) may be adjustable.

The water for the nozzles 78 is supplied from an onboard submersible pump 69 located on the dredging vessel 30, as shown in FIG. 1. In the embodiment shown, the onboard submersible pump 69 is located on the leg 30*a* of the dredging vessel 30, but in other embodiments, the pump 69 may be located on leg 30*b*, or at any other location on the dredging vessel 30 with access to the water.

In an embodiment, the pump 69 may be an electric pump, a gas pump, or a diesel pump. The pump 69 may have any size outlet, with the size of the outlet determined by the amount of water pressure desired, the number of nozzles 78, and/or any other number of factors which will be understood to those of skill in the art. The pressure may be varied using the submersible pump 69 to eliminate soft material from blowing away from the shroud 62.

Figure 11:
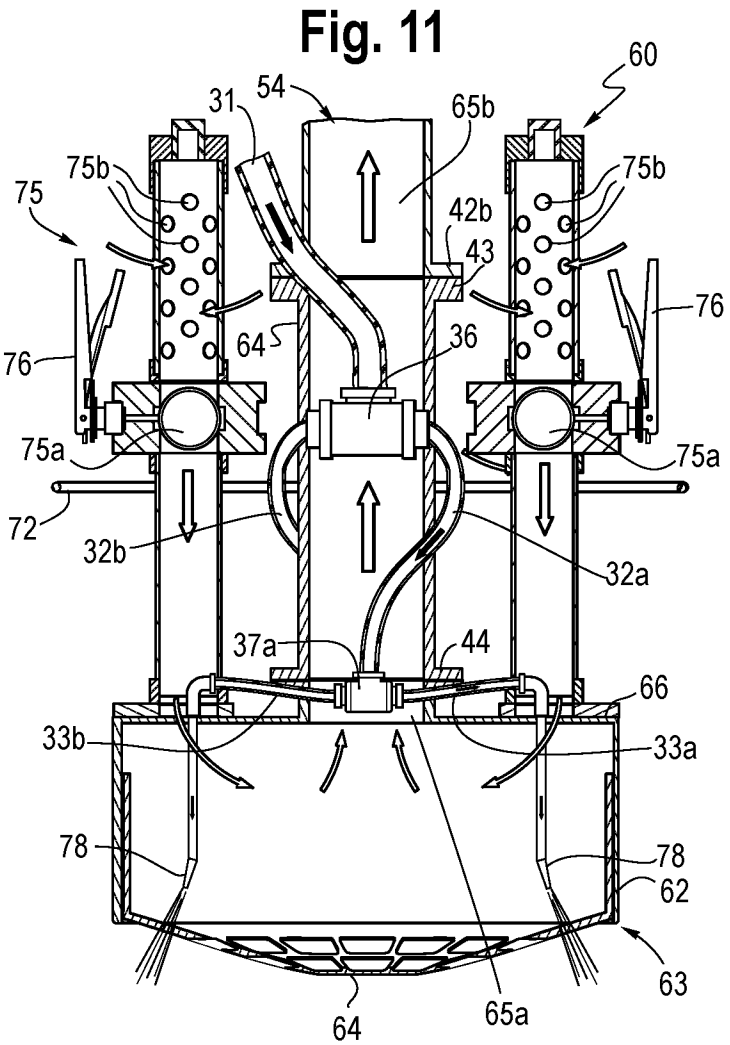
FIG. 11 is a schematic cross-sectional view showing the dredge head assembly of FIGS. 3-5 with bypass activation, in accordance with embodiments of the present disclosure.
Figure 10:
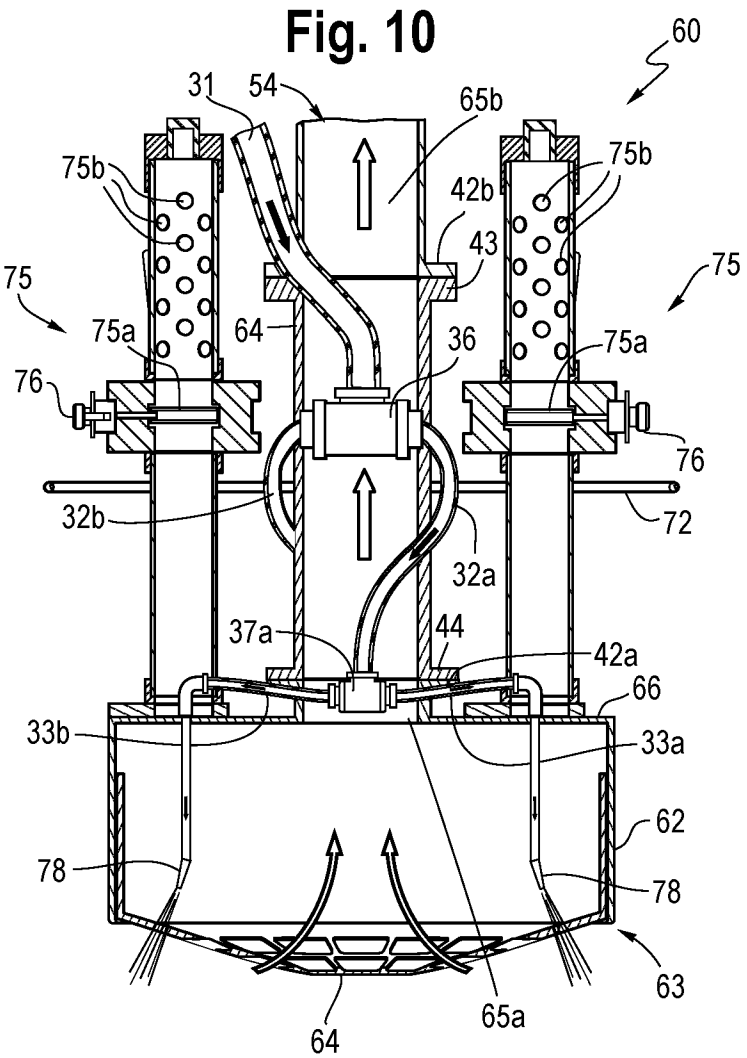
FIG. 10 is a schematic cross-sectional view showing the dredge head assembly of FIGS. 3-5 in normal use in accordance with embodiments of the present disclosure.

With reference to FIGS. 10 and 11, the water is pumped from the submersible pump 69 downward to the dredge head assembly 60 using a first pipe 31. The water then enters a first valve unit 36 which divides the water stream into two outputs. Pipes 32*a*, 32*h* then transfer the water to second valve units 37*a*, 37*b* (not shown) which further divide the respective streams into two outputs, with pipes 33*a*, 33*b*, 33*c*, 33*d* connecting to the nozzles 78.

In an embodiment, the dredge head assembly 60, and moreover the whole system 100, is free from mechanical agitation devices/structures. In other words, the dredge head assembly 60 and system 100 do not mechanically agitate the material being removed. This is advantageous because the dredge head assembly 60 hovers over the targeted area, never coming into contact with the material until it is pulled from its resting placed, resulting in less sediment suspended in the water. This can result in better visibility in the work area and, in instances when the sediment may have an amount of contamination, less spread of contaminated sediment.

A handle 72 is mounted to or near the upper end 66 of the shroud 62 and containing at least one grasping portion (e.g., section configured for grasping by a diver). In one embodiment, the handle 72 is connected to and extending from the shroud. In another embodiment, the handle 72 is connected to and extending upwardly from the shroud. In still another embodiment, the handle 72 is connected to and extending from the shroud so as to be accessible to a diver. In an embodiment, the handle 72 is connected to and extending upwardly from the shroud so as to be accessible to a diver. In the embodiment shown, the handle 72 is ring-shaped and may therefore be grasped at any location around the handle 72. However, in other embodiments, the handle 72 may have a different shape or configuration such that specifically located grasping portions are provided.

In an embodiment, the handle 72 is mounted to the shroud 62 using standoffs. The handle 72 facilitates maneuvering and/or handling of the dredge head assembly 60 by the diver or team of divers (FIGS. 1 and 12). In an embodiment, the height of the handle 72 will be designed to match an ergonomic height for a diver to eliminate bending over. For example, in an embodiment, the height of the handle 72 may be adjustable.

One or more vacuum relief valve assemblies 75 are secured in relation to the shroud 62. In an embodiment, the number of vacuum relief valve assemblies 75 may be considered in view of the size of the suction pipe 65, the amount of suction used, and the type of sediment being dredged. In the embodiment shown, the dredge head assembly 60 includes two vacuum relief valve assemblies 75, each mounted to the top of the shroud 62. Each valve assembly 75 has one or more actuation mechanisms 76 (e.g., wheel, knob, etc.) positioned to be actuated by the one or more divers (not shown), a valve mechanism 75*a* (e.g., a butterfly valve), and at least one opening 75*b*. In the embodiment shown, the actuation mechanisms 76' are specifically located to be accessible to a diver. In an embodiment, such location may be, for example, above the handle 72' and, in some embodiments, in near proximity to the handle 72'. Positioning the actuation mechanisms 76' above and in proximity to the handle 72' assists a diver in quickly locating and activating the actuation mechanisms 76', particularly in low visibility or urgent situations.

FIG. 10 shows an embodiment of the dredge head assembly 60 in which the vacuum relief valve assemblies 75 are off. FIG. 11 shows an embodiment of the dredge head assembly 60 in which the vacuum relief valve assemblies 75 have been activated by moving the actuation mechanisms 76, which in the embodiment shown are levers. As shown in FIG. 10, the valve mechanisms 75*a* are closed, with no water flowing through openings 75*b*. Activation of the actuation mechanisms 76 opens the valve mechanisms 75*a*, thereby permitting water to flow through openings 75*b* and into the shroud 62 to get sucked into the suction pipe 65, as shown in FIG. 11. In other words, the water from the vacuum relief valve assemblies 75 is suctioned so that no material is suctioned through the gatling plate 64.

As will be appreciated, the vacuum relief valve assemblies 75 serve at least two primary purposes. First, the vacuum relief valve assemblies 75 can be used to vent or "burp" air out when the dredge head assembly is submerged so as to let air out and/or to adjust buoyancy. The vacuum relief valve assemblies 75 also allow a diver to free the dredge head assembly 60 from the river bottom or obstacle, should the dredge head assembly 60 sucks tight to such object, or in case of cavitating situations in which water is blocked from the suction pipe 65 as a results of debris. Similarly, in the event a diver or component of a diver's rig (e.g., umbilical) get sucked into or become stuck against the dredge head assembly 60, the vacuum relief valve assemblies 75 may be actuated to stop the vacuum and release the diver or component of the diver's rig. The vacuum relief valve assemblies 75 may therefore also be termed "bypass" valves, since they bypass the suction associated with the suction hose 65, as described above with reference to FIG. 11.

Figure 6:
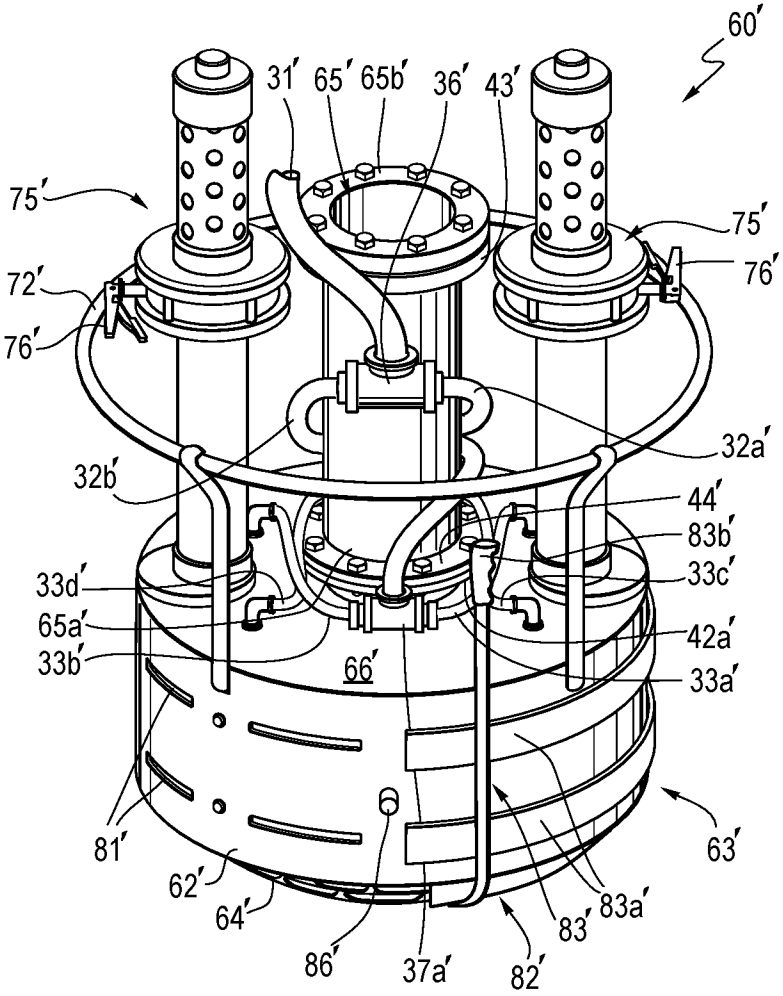
FIG. 6 is an enlarged top perspective view of a second embodiment of a dredge head assembly for use with the diver assisted dredging system of FIG. 1 and in accordance with embodiments of the present disclosure.
Figure 8:
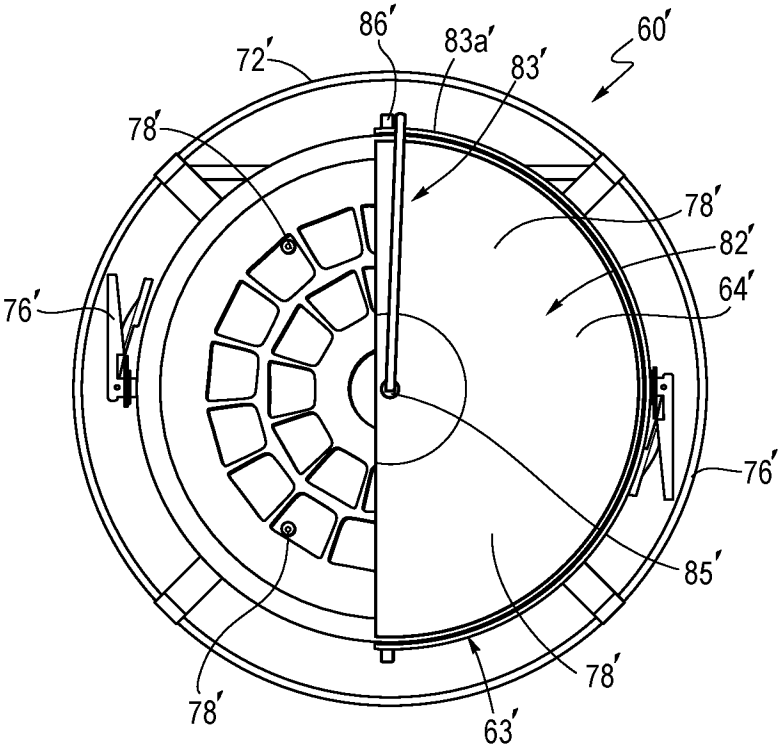
FIG. 8 is a bottom perspective view of the dredge head assembly of FIG. 6.
Figure 7:
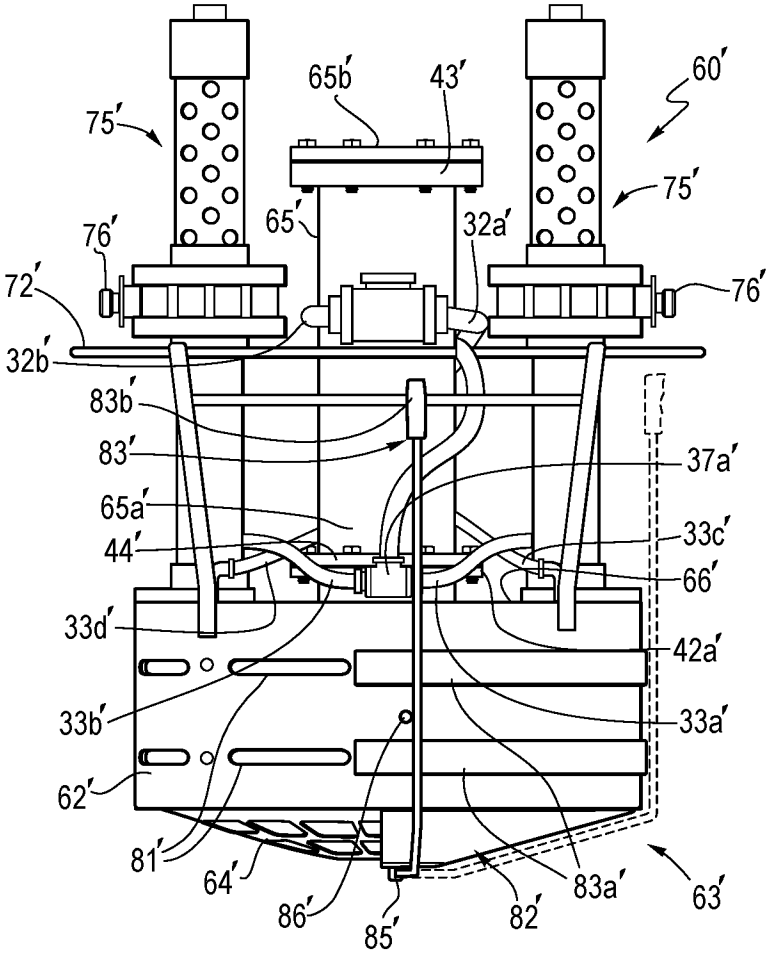
FIG. 7 is a side view of the dredge head assembly of FIG. 6.

FIGS. 6-8 show a second embodiment of a dredge head assembly 60' configured or structured for use by a diver or team of divers 90. The dredge head assembly 60' of this embodiment includes several of the same components and structures as the dredge head assembly 60 of FIGS. 1-5 and 10-12, with like components and structures referenced with like numbers. The dredge head assembly 60' also demonstrates at least the same advantages of the dredge head assembly 60, as discussed above.

In the embodiments shown, the dredge head assembly 60' includes a shroud 62' which in the embodiment shown is a cylindrical body having a bottom end 63' that is generally open, but covered by a screen structure or gatling plate 64', with a portion of the galling plate 64' covered by a positionable damper 82', and a suction tube or pipe 65' connected to a top end 66' (e.g., such as by bolts) which connects to a flexible hose, pipe or other conduit 54' which runs up to the dredge ship 30, and specifically to the dredge pump 56' that induces suction.

In an embodiment, the shroud 62' has a size, shape and configuration as discussed with reference to FIGS. 3-5, above. Likewise, the shroud 62' may be made of any suitable material, as discussed with reference to FIGS. 3-5, above.

The suction tube or pipe 65' is connected at a first end 65*a*' to the top end 66' of the shroud 62' and at a second end 65*b*' to the flexible hose, pipe or other conduit 54' (see FIGS. 1-2) which is, in turn, connected to the vacuum-generating unit 56' (e.g., dredge pump) on the dredging vessel 30', as described above with reference to FIGS. 3-5.

Like shroud 62, shroud 62' is equipped with several features to facilitate handling, safety and agitation, including, but not limited to, the screen structure or gatling plate 64', one or more handles 72', water jet nozzles 78', and one or more vacuum relief valve assemblies 75'. In a further embodiment, shroud 62' also includes damper 82' and, optionally, can include a plurality of slits 81' circumferentially positioned around the shroud 62'.

The screen structure or gatling plate 64' protects the interior components of the dredge head assembly 60' and prohibits large rocks and debris from being caught in the dredge pump 56' and/or suction pipe 65'. In the embodiment shown, the gatling plate 64' is as described with reference to any one or combination of embodiments of gatling plate 64.

In the embodiment shown in FIGS. 6-8, the gatling plate 64' is at least partially covered by a damper 82'. With particular reference to FIG. 8, the damper 82' is connected at the center of the gatling plate 64' using a bolt 85' such that the damper 82' can pivot about the bolt 85' to selectively cover different portions of the gatling plate 64'. In the embodiment shown, the damper 82' is a solid, half-circle shaped plate; however, in further embodiments, the damper 82' may have a size and/or shape which covers more or less of the gatling plate 64' (e.g., quarter circle, rectangular, etc.), contain openings itself or be made of a mesh or screen-like material.

The bolt 85', and therefore damper 82', are connected to a handle 83'. In the embodiment shown, the handle 83' is connected to the bolt 85' and extends outward from the bolt 85' along the damper 82' at or in proximity to an edge of the damper 82'. However, in further embodiments, the handle 83' may extend outward from the bolt 85' at an position along the surface of the damper 82'.

As illustrated best in FIG. 7, pivotal movement of the handle 83' causes a corresponding pivotal movement of the damper 82' to cover different openings on the gatling plate 64'. In the embodiment shown, the handle 83' is configured to be grasped by a diver (not shown) at grasping portion 83*b*'. Because agitation and sucking primarily occurs at the leading portion of the dredge head assembly 60', and the dredge head assembly 60' is usually always moving, dredging can be more effective when the tailing portion of the dredge head assembly 60' is blocked off or the jetting/suction is otherwise limited at the tailing portion. In other words, as a diver (not shown) guides the dredge head assembly 60' in a direction (e.g., forward), the diver (not shown) uses the handle 83' to pivot the damper 82' to cover a portion of the gatling plate 64' opposite the leading portion of the dredge head assembly 60' relative to the direction of travel (e.g., rear). Therefore, if the dredge head assembly 60' is moving in a forward direction, the rear portion of the gatling plate 64' is covered by the damper 82'. Similarly, if the dredge head assembly 60' is moving to right, the left portion of the gatling plate 64' is covered by the damper 82'.

Also shown in FIGS. 6-8 is stopper 86', which prevents the handle 83', and therefore damper 82' from pivoting too far. In the embodiment shown, in which the damper 82' is a half-circle, it will be appreciated that the stopper 86' is positioned to permit the damper 82' to move to cover the full range of the gatling plate 64'. The stopper 86' may therefore function more to keep the handle 83' from traveling around the shroud 62' and potentially out of reach of a diver. However, as will be appreciated by one skilled in the art, the specific location of the stopper 86', and indeed, its presence at all, will depend on the size and configuration of the damper 82', the design of the dredge head assembly 60' (e.g., whether the dredge head assembly 60' will always travel in direction at a given orientation), and the configuration of the gatling plate 64', among other factors.

In the embodiments shown in FIGS. 6-8, the shroud 62' also illustrated as including the optional slits 81' around the circumference of the shroud 62'. In the embodiment shown, the shroud 62' includes two discontinuous (e.g., segmented) slits 81', the slits 81' occurring at different heights on the shroud 62', with the segments of each of the two slits 81' occurring at the same position around the shroud 62'. These slits 81' provide suction along the sides of the shroud 62' to collect sediment that disperses in the water around the shroud 62' due to agitation. Again, while the embodiment illustrated includes both the damper 82' and slits 81', the two can be present independently, resulting in embodiments including both slits and a damper, a damper without slits, and slits without a damper.

As described above, agitation and sucking primarily occurs at the leading portion of the dredge head assembly 60'. As such, in some embodiments, and as shown in FIGS. 6-8, it may be beneficial to cover at least a portion of the segments of the slits 81' that are on the tailing portion of the shroud 62'. To that end, the handle 83' includes one or more widened portions 83*a*' configured to cover at least a portion of the slits 81' corresponding to at least a portion of the damper 82'.

Figure 9:
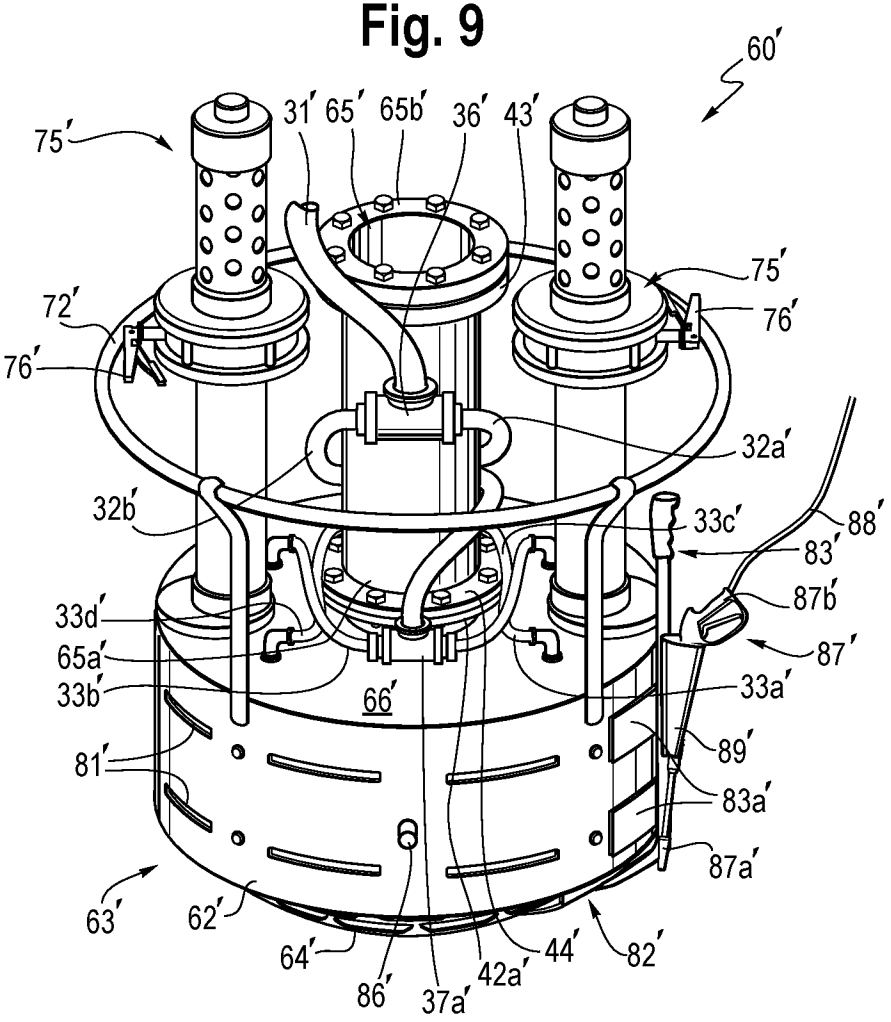
FIG. 9 is an enlarged perspective view of a third embodiment of a dredge head assembly for use with the diver assisted dredging system of FIG. 1 and in accordance with embodiments of the present disclosure.

According to embodiments of the present invention, the dredge head assembly 60' also includes a plurality of water jet nozzles 78', such as water jet nozzles 78 described with reference to FIGS. 3-5, above. In addition to the nozzles 78', in some embodiments, and as shown, for example, with reference to FIG. 9, the dredge head assembly 60' may further include a water jet wand 87'. As shown in FIG. 9, the water jet wand 87' is configured to be a hand-held unit having a nozzle 87*a'* at a first end, a grasping portion 87*b'* at a second end, and a water line 88' which connects to a water pump (such as pump 69 described above with respect to FIGS. 1-2). A diver (not shown) can use the wand 87' to help clear debris from the gatling plate 64' or other portion of the dredge head assembly 60' or provide further agitation to the sediment being dredged.

In an embodiment, the water jet wand 88' may be designed to be on at all times, or, alternatively, include a switch for diver to turn the water jet wand 88' on and off as needed. Such switches are known in the art.

In the embodiment shown in FIG. 9, the water jet wand 88' is secured to the dredge head assembly 60' using a holster-like structure 89'; however, in further embodiments, the wand 88' may be releasably secured to the dredge head assembly 60' using other structures and devices known in the art.

Like dredge head assembly 60, one or more vacuum relief valve assemblies 75' are secured in relation to the shroud 62'. In an embodiment, the number of vacuum relief valve assemblies 75' may be considered in view of the size of the suction pipe 65', the amount of suction used, and the type of sediment being dredged. In the embodiment shown, the dredge head assembly 60' includes two vacuum relief valve assemblies 75', each mounted to the top of the shroud 62'.

Each valve assembly 75' has one or more actuation mechanisms 76' (e.g., wheel, knob, etc.) positioned to be actuated by the one or more divers (not shown), a valve mechanism 75*a'* (e.g., a butterfly valve), and at least one opening 75*b'*. In the embodiment shown, the actuation mechanisms 76' are specifically located to be accessible to a diver. In an embodiment, such location may be, for example, above the handle 72' and, in some embodiments, in near proximity to the handle 72'. Positioning the actuation mechanisms 76' above and in proximity to the handle 72' assists a diver in quickly locating and activating the actuation mechanisms 76', particularly in low visibility or urgent situations.

As will be appreciated, the vacuum relief valve assemblies 75' function as described with reference to FIGS. 10 and 11, above.

In an embodiment, the dredge head assembly 60/60' includes one or more float bags/pipes on the sides of the shroud 62/62'. The float bags/pipes may be inflated/deflated as needed to adjust/control the buoyancy of the dredge head assembly 60/60' along with the adjustments provided by the vacuum relief valve assemblies 75/75'.

In further embodiments, the dredge head assembly 60/60' may further include an inclinometer. The inclinometer informs the operator if the angle of the dredge head assembly 60/60' is not level to the water body bottom. The inclinometer may be read directly by a diver and/or the information fed to a computer or display on the dredging vessel 30. The position of the dredge head assembly 60/60' may be adjusted based on information from an inclinometer. In embodiments in which the information from the inclinometer is fed to a computer, an adjustment to the dredge head assembly 60/60' may be made automatically.

Any sensor that can provide this information can be used, and the sensor that is standard on a Dredging Supply Company 8-inch Moray dredge articulating ladder is exemplary. The information is also provided to Dredgepack software available from Hypack, Inc. in which it is used to determine the final elevation of the suction attachment at any position.

In accordance with an exemplary embodiment, the line velocities are maintained at about 4,500 liters per minute (LPM, 1,200 gallons per minute (GPM)) to about 5,678 LPM (1,500 GPM) to ensure no settlement of larger granule materials in the discharge line. This, of course, depends on the type of material being pumped as well as the distance being pumped.

The preferred operating conditions for this system 100 include a shallow substrate face ranging from 3 inches up to 5 feet of fine sediment material layered on a hard clay or gravel bottom, Preferably, however, the substrate face includes from 3 inches up to 1-2 feet of fine sediment. Depth of the material below the water surface is inconsequential, although it is contemplated the system 100 will typically operate in water up to a depth of 30 feet, with shallower water (up to 2.0 feet, preferably up to 10 feet, more preferably up to 8 feet, and even more preferably up to 6 feet) preferred. Area coverage can average up to 25 yards per hour using an attachment and system of the size described above, although in practicality, the area coverage will be less than this amount while still higher than comparable diver-assisted designs as described above.

Diver Assisted Dredging Method

According to embodiments of the present invention, a diver-assisted dredging method for avoiding underwater utility cables, pipes, conduits and other underwater obstacles is provided herein.

In an embodiment, a guide barge is positioned to straddle utilities or other obstacles. By straddling the utilities or other obstacles, no equipment needs to spud in a location immediately adjacent a utility or obstacle (e.g., within 25 feet of a utility or obstacle, or within 50 feet of a utility or obstacle).

In an embodiment, the guide barge is provided according to any one or combination of embodiments described herein.

A dredging vessel is moored to the guide barge and configured to slide along the guide barge. Typically, and as shown in FIGS. 1-2, an towing assembly is used on the guide barge to tow the dredging vessel.

In an embodiment, the dredging vessel and towing assembly are each, independently, according to any one or combination of embodiments of the dredging vessel and towing assembly, respectively, described herein.

A diver or team of divers walks alongside a dredge head assembly which hangs from the dredging vessel. The diver or team of divers watch the progression of the dredge head, guide it over the dredging area as needed, and watch for exposed utilities. In embodiments, the diver (or at least one diver from a team of divers) will be in direct communication with the dredge operator on any obstacles encountered.

In an embodiment, the dredge head assembly is according to any one or combination of embodiments described herein.

Once the guide barge, dredging vessel, dredge head assembly, and diver(s) are in position, dredging operations will begin. Initially, dredging will begin by activating the vacuum. In an embodiment, dredging will begin without jetting. In such an embodiment, jetting is initiated if it is determined dredging success or production seems limited due to no agitation. In other embodiments, some amount of jetting will occur during the duration of dredging.

In an embodiment, the jetting pressure is varied depending on the type of material being dredged. Lighter/finer material needs only a low pressure to be agitated, while heavier/bulkier material may require a greater pressure to be agitated.

In an embodiment, if the dredge head assembly continues to provide inadequate agitation, a diver operated jet nozzle can be employed.

In an embodiment, if the suction velocity is determined to be a limiting factor in terms of dredging success or production, the pump speed is increased to provide more suction. In other embodiments, the shroud of the dredge head assembly is adjusted (i.e., reduce diameter of shroud) to generate a higher suction velocity. Similarly, if the suction velocity becomes too great (e.g., if the sediment properties change), the pump speed may be decreased and/or the diameter of the shroud increased to lessen the suction velocity.

Typically, the removed material is dewatered and transported to landfills, and this process is very costly. If additional material is removed along with the targeted (e.g., contaminated) material, whether intentionally or otherwise, then this non-targeted material requires the same disposal methods as does the targeted material. By adjusting pump speeds and swing rates, materials can be effectively removed according to their densities, thereby potentially limiting the amount of non-targeted material removed.

In an embodiment, one of the divers (or the diver) carries a remote to control the swing of the ladder. In an embodiment, such a remote would be a simple remote containing two buttons (e.g., left and right). In other embodiments, such a remote may be more complex and include additional buttons, such as, for example, to control speed of movement. In other embodiments, the speed of the ladder swing will be at a lowest setting at all time or otherwise controlled by a worker aboard the dredging vessel or towing assembly.

During dredging operations, the towing assembly operator will be in direct communication with the dredge operator to coordinate movements forward. The approximate step length is usually around 3 feet with dredging lanes approximately 30 feet wide. In embodiments in which the dredge head support assembly 50 is a swinging ladder, the dredge ship 30 will utilize the dredge head support assembly 50 to gain the side-to-side movement necessary to reach the 30-foot wide lanes. It will be appreciated that dredging will occur in an arc-like pattern due to the swinging ladder.

Unlike former dredging practices, the dredging vessel 30 will operate with one wide pass instead of three passes (e.g., what is typical with a cutter head dredge).

Upon completion of a dredge lane, the guide barge 10 will be shifted to the next lane in a controlled manner. First one spud 15 will be lifted and the guide barge 10 will be pivoted to the next lane. Once in position, that spud 15 would be lowered before the next spud 15 is lifted. The crew will then pivot off the opposite spud 15 until the guide barge 10 is in position for the next lane.

In an embodiment, an exemplary method for diver-assisted dredging as disclosed herein begins with identifying a region (e.g., a contaminated region) and mapping the region. In an embodiment, the region is mapped into a number of lanes. According to some embodiments, mapping includes identification of various variables, including the type of material to be suctioned and guide barge/towing assembly/dredging vessel movement sequence. After the region is mapped, the guide barge is positioned at a dredging sequence starting position. The towing assembly is then positioned on the guide barge so that the dredging vessel is in the appropriate position. The dredge head assembly 60 and diver (or team of divers) are then deployed below to the desired depth and dredging begins. While dredging occurs, operators on the guide barge, towing assembly and dredging vessel, along with the diver(s), monitor the depth and orientation of the dredge head assembly relative to the surface being dredged. If adjustments are needed, the diver(s) and/or dredge ship operator and/or towing assembly operator make the necessary adjustment.

In some instances, it may be necessary or desirable to bypass the vacuum (stop suction), such as, for example, to "burp" the dredge head assembly, to clear debris from the suction pipe or release a diver/diver's gear from the dredge head assembly. To bypass the vacuum one or more divers actuate the vacuum relief valve assemblies 75 until either a "burp" occurs or debris/other object is cleared from the dredge head assembly 60.

As dredging occurs, the towing assembly moves along the guide barge so that a full lane is dredged. After a lane is dredged, the positioning device on the guide barge (and dredging vessel, if applicable) coordinate movement to reposition the guide barge (and thereby towing assembly and dredging vessel) in the next lane.

A diver-assisted method of dredging may be in accordance with any embodiment, or combination of embodiments, described above. In one exemplary embodiment, for example, a diver-assisted method of dredge comprises providing a dredging system as described herein and using the dredging system to accomplish dredging in an area to be dredged.

In accordance with embodiments of the disclosure, the step of providing a dredging system comprising a guide barge, a towing assembly, a dredging vessel and a dredge head assembly, wherein the towing assembly is in communication with and configured to travel along the guide barge, wherein the dredging vessel is moored to the towing assembly so as to slide along the guide barge, the dredge head assembly according to any embodiment or combination of embodiments described herein.

In accordance with an embodiment, for example, the dredge head assembly for use in the diver-assisted method of dredging comprises a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver.

In an embodiment, the method further comprises positioning the guide barge with respect to an obstacle and positioning, using the towing assembly, the dredging vessel with respect to the area to be dredged. In one embodiment, the step of positioning the guide barge with respect to an obstacle may include positioning the guide barge so as to straddle the obstacle.

In one embodiment, the method includes scouting or otherwise inspecting the area to be dredged, wherein a diver accomplishes the scouting or otherwise inspecting. A diver may scout or inspect the area to be dredged at any time prior to dredging (e.g., before providing the diver-assisted dredging system, before positioning any of the components of the diver-assisted dredging system, or any time prior to initiating dredging while the system is still being provided or set-up) or at any time during dredging (e.g., "in real time").

In an embodiment, the diver-assisted dredging method includes the step of one or more divers actuating at least one of the one or more vacuum relief valve assemblies of the dredge head assembly.

In still a further embodiment, the diver-assisted method of dredging includes the step of one or more diver guiding the dredge head assembly about the obstacle.

Testing and Results

The diver-assisted dredging system 100 was tested to define preferred operating procedures. First, a pre-dredge survey was conducted to model an area that had ideal characteristics for the diver-assisted dredging system 100 and dredge head assembly 60/60' The area had a layer of soft sediment measuring 1-2 feet thick on top of a compact clay bottom. Polychlorinated biphenyls (PCB) tests were not conducted to determine the level of contamination.

A 4-5 hour period of dredging was scheduled y. The area dredged during the testing was 25-30 feet wide, so 25 feet were covered in 1 set, or swing of the dredge head support assembly 50. Operators tried different techniques to acclimate themselves with the diver-assisted dredging system 100 and dredge head assembly 60. For instance, various ladder swing speeds, speeds of travel (e.g., towing assembly/dredging vessel movement), and dredge RPMs were tested.

For the test, the submersible water pump connected to the nozzles 78 was a 40 horse power pump having a 2-inch outlet and which was run at an output of 40-50 psi.

For the tests, only a single pass was completed on the area being dredged. It was determined that additional passes were not necessary because the target amount of material was collected in the single pass.

During the test, while the diver was near the dredge head assembly, the operator adjusted pump speeds to determine vacuums and flows. The system operated at 1,600 GPM (gallons per minute) during the test.

The test was initially started without any water jetting, but it did not appear that enough suction was created to dredge the necessary material. When the water jet was utilized, the agitation led to better production. Depending on the type of material and conditions of dredging, the direction/location of nozzles may be adjusted.

The height of the dredge head assembly over sediment was also tested. The test was initiated with the dredge head assembly being approximately 6 inches over the sediment. The diver observed that there was little effect on the sediment (e.g., agitation and suction) at this height. The dredge head assembly was then lowered to a height of approximately 3 inches over the sediment. At that height, approximately 3-6 inches of sediment was removed during a pass.

The ladder swing speed was adjusted throughout the test. It was determined that the ladder swing speed can vary depending on dredging conditions and materials, so no set or target swing speed was determined.

Visual turbidity inspections were also conducted. No turbidity was visually identified at the water surface. The visual turbidity inspections were conducted when dredging at a depth of approximately 25 feet. No visual turbidity inspections were completed at depth.

No cavitation issues were experienced during the test.

Exemplary Embodiments

The following exemplary embodiments are not intended to be limiting but are intended to include modified forms and embodiments as described previously herein:

E1. A dredge head assembly comprising: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver.

E2. The dredge head assembly of E1, wherein the shroud has a diameter of approximately 30 inches. E3. The dredge head assembly any of E1-E2, wherein the actuation mechanism of the one or more vacuum relief valve assemblies is in close proximity to the handle. E4. The dredge head assembly of any of E1-E3, wherein the dredge head assembly is negatively buoyant in freshwater. E5. The dredge head assembly of any of E1-E4, wherein the shroud is made of a polymeric material. E6. The dredge head assembly of E5, wherein the polymeric material is high density polyethylene. E7. The dredge head assembly of any of E1-E6, wherein the first end of the suction pipe comprises a fish-mouth shaped opening and the first end of the suction pipe is connected to and over a corresponding fish-mouth shaped opening in the top end of the shroud. E8. The dredge head assembly of any of E1-E7, further including a plurality of water jet nozzles configured to connect to a pump. E9. The dredge head assembly of E8, wherein the water jet nozzles are housed within the shroud and circumferentially spaced relative to the screen structure. E10. The dredge head assembly of E9 wherein the dredge head assembly comprises four water jet nozzles. E11. The dredge head assembly of any of E1-E10, wherein the dredge head assembly is free from mechanical agitation devices.

E12. A diver assisted dredging system comprising a dredge head assembly comprising: a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver; and a towing assembly comprising a dredge head support assembly, wherein the dredge head assembly is connected to and suspended from the dredge head support assembly.

E13. The diver assisted dredging system of E12 further comprising a guide barge, wherein the towing assembly is in communication with the guide barge. E14. The diver assisted dredging system of any of E12-13 wherein the dredge head support assembly is stationary. E15. The diver assisted dredging system of any of E12-13 wherein the dredge head support assembly is configured to swing. E16. The diver assisted dredging system of any of E12-15, wherein the towing assembly is a crane or boom-containing assembly.

E17. A diver assisted dredging system comprising: a guide barge; a dredging vessel comprising a dredge head support assembly; a towing assembly in communication with the guide barge and dredging vessel, the towing assembly configured to reposition the dredging vessel relative to the guide barge; and a dredge head assembly connected to the dredge head support assembly of the dredging vessel by a flexible hose, the dredge head assembly comprising a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver.

E18. The diver assisted dredging system of E17, wherein the dredge head support assembly is a ladder. E19. The diver assisted dredging system of E18, wherein the ladder is a stationary ladder. E20. The diver assisted dredging system of E18, wherein the ladder is configured to swing. E21. The diver assisted dredging system of any of E17-20 wherein the one or more vacuum relief valve assemblies are each configured for activation by at least one diver. E22. The diver assisted dredging system of any of E17-21, wherein the guide barge includes at least two positioning devices. E23. The diver assisted dredging system of any of E17-22, wherein the towing means is selected from the group consisting of a vehicle and a winching system. E24. The diver assisted dredging system of any of E17-23, wherein the guide barge has a length of at least 50 feet.

E25. A diver-assisted method of dredging, the method comprising: providing a dredging system comprising a towing assembly and a dredge head assembly, wherein the dredge head assembly is connected, directly or indirectly, to the towing assembly and wherein the dredge head assembly comprises a shroud having a generally open bottom end and a top end; a screen structure covering the generally open bottom end of the shroud; a suction pipe with a first end connected to the top end of the shroud and a second end configured to be operatively connected with a pump which induces suction; a handle connected to and extending from the shroud and having at least one grasping portion; and one or more vacuum relief valve assemblies, each comprising a valve, at least one opening configured to be in communication with water, and an actuation mechanism positioned to be accessible to a diver; and using the dredging system to accomplish dredging in an area to be dredged.

E26. The method of E25, further comprising positioning the towing assembly with respect to an area to be dredged. E27. The method of E26, wherein the step of positioning the towing assembly with respect to an area to be dredged further comprising positioning the towing assembly with respect to an obstacle located in the area to be dredged. E28. The method of any of E25-27, wherein the dredge head assembly is connected to the towing assembly via a dredge head support assembly. E29. The method of any of E25-27, wherein the towing assembly comprises a dredge head support assembly and the dredge head assembly is connected to and suspended from the dredge head support assembly. E30. The method of E29, further comprising moving the dredge head assembly a distance by moving the towing assembly or dredge head support assembly. E31. The method of any of E25-27, wherein the dredge head assembly is indirectly connected to the towing assembly. E32. The method of E31, wherein the dredging system comprises a dredging vessel, wherein the dredge head assembly is connected to the dredging vessel and the dredging vessel is moored to the towing assembly and the towing assembly. E33. The method of E32, further comprising moving the dredge head assembly a distance by using the towing assembly to move the dredging vessel. E34. The method of E32, wherein the dredging system further comprises a guide barge, wherein the towing assembly is in communication with and configured to travel along the guide barge, and wherein the dredging vessel is moored to the towing assembly so as to slide along the guide barge. E35. The method of E34, further comprising moving the dredge head assembly a distance by moving the towing assembly a distance along the guide barge and thereby moving the dredging vessel the distance along the guide barge. E36. The method of E34, further comprising: positioning the guide barge to with respect to an obstacle; and positioning, using the towing assembly, the dredging vessel with respect to the area to be dredged. E37. The method of any of E25-36, further comprising scouting or otherwise inspecting the area to be dredged, wherein a diver accomplishes the scouting or otherwise inspecting. E38. The method of E36, wherein the step of positioning the guide barge with respect to an obstacle comprises positioning the guide barge so as to straddle the obstacle. E39. The diver-assisted method of dredging of any of E25-38, further comprising the step of one or more divers actuating at least one of the one or more vacuum relief valve assemblies. E40. The diver-assisted method of dredging of E39, further comprising the step of the one or more divers guiding the dredge head assembly about an obstacle.

Again, many other variations to the diver assisted dredging system 100 and dredge head assembly 60, and respective components, are possible and considered within the scope of the claims. Moreover, the components can be sized and shaped depending on the overall project and/or application and can be varied, to at least some extent, without departing from the scope of the present invention. Further, any statements provided regarding safety or features which may provide improved safety are not intended to guarantee, warrant or represent the safety of the dredge head assembly, system or method disclosed herein.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A diver assisted dredging system comprising:

a guide barge;

a dredging vessel comprising a dredge head support assembly;

a towing assembly in communication with the guide barge and dredging vessel, the towing assembly configured to reposition the dredging vessel relative to the guide barge; and a dredge head assembly connected to the dredge head support assembly of the dredging vessel by a flexible hose, the dredge head assembly comprising a shroud having a generally open bottom end and a top end;

a screen structure covering the generally open bottom end of the shroud;

a suction pipe with a first end connected generally vertically and centrally to the top end of the shroud and a second end configured to be operatively connected with a pump which induces suction;

a circular ring-shaped handle connected to and extending upward from the shroud and having at least one grasping portion; and one or more vacuum relief valve assemblies, each comprising a valve, at least one opening configured to be in communication with water, and an actuation mechanism positioned to be accessible to a diver;

wherein the actuation mechanism of the one or more vacuum relief valve assemblies is in close proximity to the ring-shaped handle.

2. The diver assisted dredging system of claim 1, wherein the dredge head support assembly is a ladder.

3. The diver assisted dredging system of claim 2, wherein the ladder is a stationary ladder.

4. The diver assisted dredging system of claim 2, wherein the ladder is configured to swing.

5. The diver assisted dredging system of claim 1, wherein the one or more vacuum relief valve assemblies are each configured for activation by at least one diver.

6. The diver assisted dredging system of claim 1, wherein the guide barge includes at least two positioning devices.

7. The diver assisted dredging system of claim 1, wherein the towing means is selected from the group consisting of a vehicle and a winching system.

8. The diver assisted dredging system of claim 1, wherein the guide barge has a length of at least 50 feet.

* * * * *